United States Patent [19]

Teague, Jr.

[11] Patent Number: 4,876,764

[45] Date of Patent: Oct. 31, 1989

[54] CLOSER HAVING DOOR POSITION INDICATOR

[75] Inventor: Ralph T. Teague, Jr., Monroe, N.C.

[73] Assignee: Yale Security Inc., Monroe, N.C.

[21] Appl. No.: 258,704

[22] Filed: Oct. 17, 1988

[51] Int. Cl.[4] ..... G08B 13/08

[52] U.S. Cl. ..... 16/71; 49/13

[58] Field of Search ..... 16/71; 49/13, 14

[56] References Cited

U.S. PATENT DOCUMENTS

| | | | |
|---|---|---|---|
| 4,220,051 | 9/1980 | Catlett | 49/336 |
| 4,333,270 | 6/1982 | Catlett | 49/336 |
| 4,334,388 | 6/1982 | Kambic | 49/14 |
| 4,562,664 | 1/1986 | Kambic | 49/14 |
| 4,721,946 | 1/1988 | Zunkel | 49/13 |

*Primary Examiner*—Nicholas P. Godici
*Assistant Examiner*—Carmine Cuda
*Attorney, Agent, or Firm*—Dallett Hoopes

[57] ABSTRACT

A door closer has a cam surface on its pinion shaft. A lever mounted thereadjacent works against the shaft, and when the door is closed, engages a switch to indicate remotely the condition of the door. The lever fulcrum is mounted on an eccentric arrangement so that the change from "door closed" to "door opened" position can be set at a precise point.

7 Claims, 1 Drawing Sheet

CLOSER HAVING DOOR POSITION INDICATOR

BACKGROUND OF THE INVENTION

1. Field of the Invention

This invention relates to a door closer including apparatus for indicating the position of the door. The invention is especially suitable for installation in connection with a penitentiary cell door or door to any other room where security is important. More specifically, the invention relates to a door closer in which the pinion shaft is formed with a cam surface and a lever is mounted thereadjacent and works against the cam surface, the lever actuating an indicator switch to indicate remotely whether the door is open or closed as reflected from the position of the cam on the pinion shaft. Still more specifically, the invention includes eccentric means for adjusting the position of the fulcrum of the lever so that the indicator gives the truest possible reading of the door position.

2. Description of the Related Art Including Information Disclosed Under §§1.97–1.99

In the prior art there are showings of door position indicators especially suitable for doors in penal institutions. An interesting example is shown in the U.S. Pat. No. 4,721,946, which issued Jan. 26, 1988 to Richard L. Zunkel. In this patent the pinion shaft of a door closer is provided with a rotary cam surface which directly actuates the lever arm of a micro-switch to indicate that the door is either closed, open or that the operator arm has been removed.

Another example of such a device is shown in the U.S. Pat. No. 4,334,388, which issued June 15, 1982 to Raymond V. Kambic. In this patent a control arm is pivoted in the door frame and moves with the door. The arm is mounted on a shaft which carries, in a friction drive mounting, a lever arm which actuates a micro-switch to indicate electrically to a remote panel the condition of the door.

Other art of interest includes two U.S. Catlett patents U.S. Pat. Nos. 4,220,051 and 4,333,270, as well as the U.S. Pat. No. 4,124,847 to Cashman.

SUMMARY OF THE INVENTION

The present invention provides a door closer having a position indicator. The closer has a pinion shaft provided with a cam surface. A lever is mounted adjacent the shaft to work against the cam surface. Movements of the lever caused by the turning of the cam surface as the pinion shaft rotates are reflected in the actuation of a micro-switch, adjacent the lever. In a preferred embodiment the lever is provided with an eccentrically mounted fulcrum by which the lever may be adjusted to accurately indicate the position of the door.

BRIEF DESCRIPTION OF THE DRAWINGS

Further features and objects of the invention will be apparent from the following specification and the drawings, all of which disclose nonlimiting embodiments of the invention. In the drawings.

DESCRIPTION OF THE PREFERRED EMBODIMENT

Figures 1, 2, 3, 4, 5, 6:
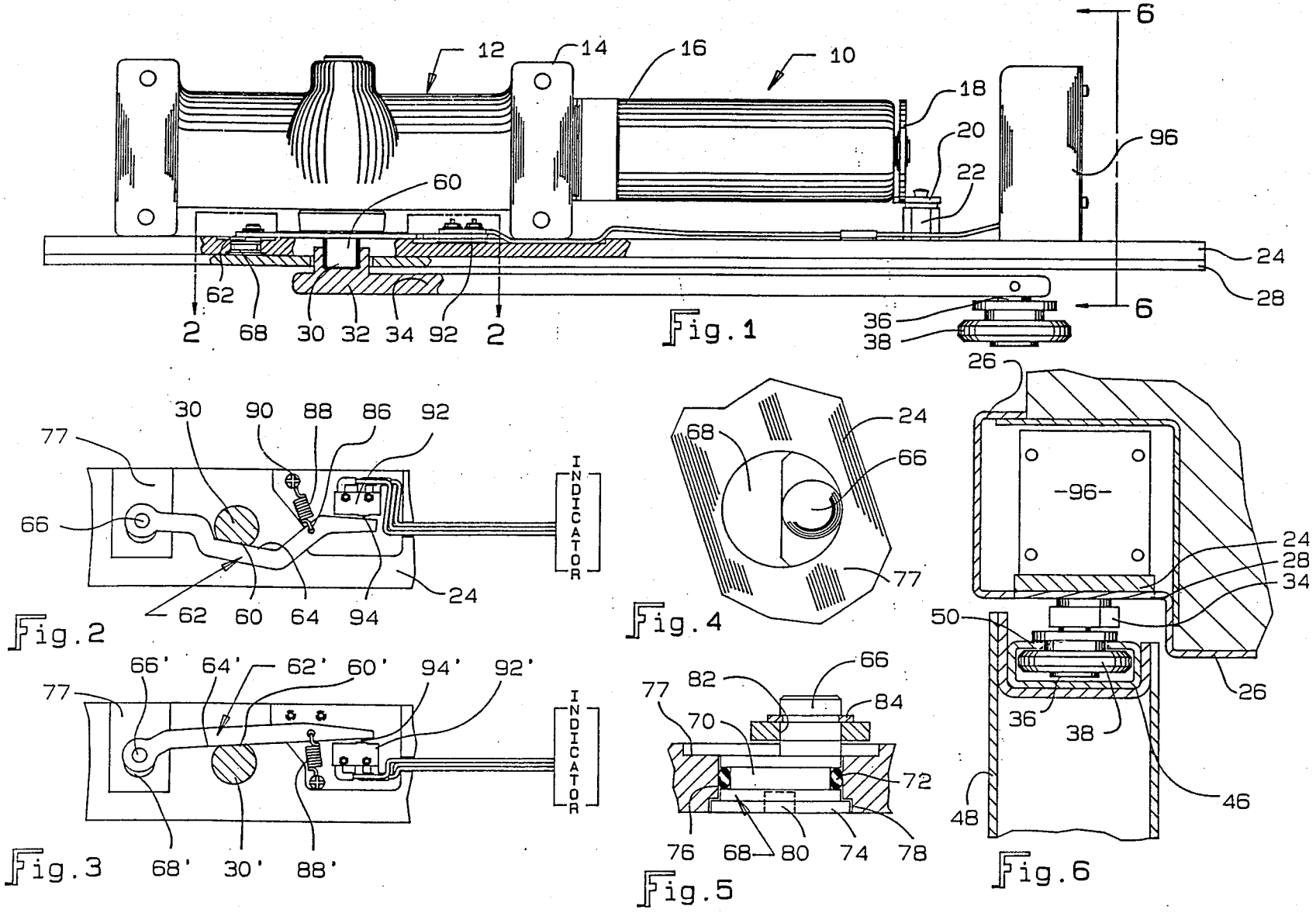
FIG. 1 is a front elevational view of a door closer having an indicator switch arrangement mounted thereadjacent, the operator arm is broken off to save drawing space.
FIG. 2 is a sectional view taken on the line 2—2 of FIG. 1.
FIG. 3 is similar to FIG. 2 but shows an arrangement for operation with the opposite hand of the door mounting.
FIG. 4 is an enlarged top view of the eccentric mounting of the fulcrum pivot for the actuating lever with the operating arm removed.
FIG. 5 is a partly sectional fragmentary view showing in detail the side elevation of the pivot mounting.
FIG. 6 is an enlarged fragmentary sectional view taken on the line 6—6 of FIG. 4.

An apparatus embodying the invention is shown in FIG. 1 and generally designated 10. It comprises a door closer 12 and a housing 14 including a spring-containing tube or cup 16. The tube has at its rightward end the usual adjustment gear 18 for the spring. The gear 18 may be rotated by rotation of the meshing gear 20 mounted for rotation in boss 22 and having a shaft operable through a conventional opening in the top of the door frame.

As shown, the closer is mounted on a base plate 24 which is secured by means (not shown) to the door frame 26 (FIG. 6). The underside of the base plate 24 is covered by a dress plate 28. Extending downward centrally of the housing 14 is the pinion shaft 30 of the closer. A hub 32 is mounted on the lower end of the closer and fixedly mounts an operating arm 34 shown partly in section.

As shown in FIGS. 1 and 6, the rightward end of the operating arm 34 has a downward shaft 36 terminating downward in a roller 38, which moves inside a formed track 50. The track is supported on the top element 46 of the door 48. As is conventional, when the door opens, the roller moves in the track in one direction "cocking" the arm 34 of the closer. When the door is released, the arm drives the door closed as the roller 38 moves in the opposite direction in the formed track. Thus the shaft 36 is coordinated with the movement of the door.

The structure so far described is a conventional door closer arrangement whereby a piston (not shown) inside the housing 12 carries a rack (not shown) which is engaged by a pinion (not shown) on the upper end of the shaft 30. The piston is urged leftward by the spring in cup or tube 16 causing the operator arm 34 to draw the door closed. The piston compresses the spring in cup 16 when the door is opening. As is conventional, hydraulic fluid in the housing 14 is worked on by the piston, and the closing speed and latching speed of the door are damped by controls which meter the flow of the oil on the return stroke of the piston.

Attention is now directed to the portion of the disclosed structure comprising the invention. Above the hub 32 the pinion shaft 30 is formed with a flat 60 (FIGS. 1, 2, and 3). As best shown in FIG. 2, a lever 62 is mounted on the base plate 24 and comprises a section 64 which works against the shaft 30. The mounting of the lever 62 is preferably by means of a fulcrum pin 66 at one end of the lever.

As shown (FIGS. 4, 5), the pin 66 is eccentrically formed on a rotatable circular mount 68. The mount is formed with a central peripheral groove 70 receiving an O-ring 72. The lower end of the mount has an outward flange 74. In assembly the mount is rotatably held in a circular opening 76 in the base plate which is recessed at 77 in the area of the opening 76. On its underside the opening 76 has an outward annular recess 78 which forms a stop shoulder for the flange 74, limiting the upward movement of the mount.

An Allen wrench socket 80 is formed centrally in the lower face of the mount 68. The O-ring 72 provides heavy friction in the rotation of the mount so that once the radial position of the mount is set, it remains in that position until moved by wrench as described.

As shown (FIG. 2), the leftward end of the lever 62 is enlarged and has a central opening 82 which receives the pin 66. A C-ring 84 snaps into a groove at the upper end of the pin 66 to hold the assembly together. The opening 82 is sufficiently large to permit free pivoting of the lever 62 on the pin 66.

Preferably, on the opposite side of the lever 62 from the pivot 66 the lever 62, which is crooked, as shown in FIG. 2, is apertured at 86 and receives one end of a spring 88. The other end of the spring is mounted by a fastener 90 to the base plate 24, biasing the lever 62 toward the pinion shaft 30. A microswitch 92 having a button actuator 94 is mounted also on the base plate 24 and is arranged so that the distal end of the lever 62 engages the button 94 to actuate the switch when the flat 60 is presented to the section 64 of the lever. Wires from the switch as shown lead to a junction box 96 as shown in FIG. 1 and from there to an indicator or signal means.

Actuation of the switch 92 in this manner puts the switch 92 in a first condition, which is indicated on a remote indicator by means of obvious electrical circuitry, as disclosed in more detail in the aforementioned patent to Kambic. When the door is opened in the arrangement shown, the shaft 30 will turn clockwise and the flat 60 will progressively face toward the left. The "corner" formed at the intersection of the shaft circle and the flat 60 causes the lever 62 to move, disengaging the button 94 and putting the switch 92 in a second condition indicating on the remote indicator that the door is opening or opened.

If the door is of opposite hand (i.e., with hinges on the right of the door instead of on the left), a rearrangement of the parts, as shown in FIG. 3, may be desired. In the FIG. 3 arrangement, a lever 62' is relatively straight and is pivoted on pin 66', fashioned identically to that as shown in FIGS. 4 and 5. The switch 92' and its button 94' are activated by the distal end of the lever 62, which is biased toward the shaft 30' by spring 88'.

Because the door associated with the setup of FIG. 3 will open in a reverse direction from the door 48, shaft 30' will move counterclockwise so that the flat 60' will move toward the left and raise the distal end of the lever 62' away from the button 94', indicating on the remote indicator that the door is opening or opened.

An important aspect of the invention is the provision of the mount 68 which moves the pin 66 or 66' in an arc as a wrench is inserted by a serviceman or installer in the socket 80 of the mount and turned. The mount can be adjusted so that an indication of the door as closed can be read at the indicator only when the door is precisely closed and the flat 60 or 60' rests evenly against the section 64 or 64' of the lever 62 or 62'. Alternatively, the fulcrum of the lever can be set so that the switch 92 does not change condition until the door is opened an inch or so. As should be understood by now, the indicator does not signal the open condition of the door until the flat 60 has turned by a preset amount depending on adjustment past the flat contact condition with the lever as shown in FIG. 2. At any rate, because of the structure disclosed, the door position indicator of the invention provides an extremely accurate reading of the door position.

In addition, it should be noted that the operation of apparatus embodying the invention is directly tied to the position of the pinion shaft 30, and does not rely on variables such as friction discs or special auxilliary cams, as with the prior art. At the same time, it should be noted that the present apparatus involves only a minor change to a conventional door closer, namely, the cutting of the flat 60 or 60' on the pinion shaft to a degree farther along the shaft than is normally done to key the hub 30 to the arm.

It is thus clear that the invention provides a door monitoring apparatus of extreme sensitivity and which is direct and reliable in operation. It is understood that variations of the invention are possible and thus the invention is not limited to the embodiments disclosed but is of a scope as defined by the following claim language or reasonable equivalents thereof.

What is claimed is:

1. A door closer having a door position indicator, the closer having an operator arm associated at one end with the door and at the other end mounted on the lower end of a vertically disposed pinion shaft of the closer, the pinion shaft having a cam surface on its periphery adjacent its lower end, the indicator comprising:

a. a switch-operating lever having a rotatable, circular mount eccentrically mounting a pivot point of the lever, a portion of the lever engaging against the periphery of the pinion shaft, b. electric switch means mounted adjacent the closer and adapted to be engaged by the lever, c. biasing means urging the lever toward the shaft, d. signal means electrically connected to the switch means whereby when the door is closed, the cam surface on the shaft causes the lever to assume a position wherein the lever puts the switch in a first condition, and when the door is not closed the cam surface causes the lever to assume a different position wherein the lever puts the switch in a second condition, and for either condition the signal means indicates accordingly.

2. A door closer having an indicator as claimed in claim 1 wherein the lateral position of the pivot point may be adjusted by manipulating the circular mount.

3. A door closer having an indicator as claimed in claim 1 wherein the lever is of a class wherein the circular mount is at one end and the switch-engaging portion is at the other end and the pinion shaft is inbetween.

4. A door closer having an indicator as claimed in claim 3 wherein the biasing means is an axial spring engaging the lever intermediate the pinion shaft and the switch.

5. A door closer having an indicator as claimed in claim 4 wherein the spring is under tension.

6. A door closer having a door position indicator as claimed in claim 3 wherein the lever is crooked.

7. A door closer having a door position indicator, the close having an operator arm associated at one end with the door and at the other end mounted on the lower end of a vertically disposed pinion shaft of the closer, the pinion shaft having a cam surface on its periphery adjacent its lower end, the indicator comprising:

a. a switch-operating lever having at one end a rotatable, circular mount eccentrically mounting a pivot point of the lever, a central portion of the lever engaging against the periphery of the pinion shaft, b. an electric micro-switch mounted adjacent the closer and adapted to be engaged by the lever at the other end of the lever, c. a coil spring attached to the lever and urging it toward the shaft, d. signal means electrically connected to the switch whereby when the door is closed, the cam surface on the shaft causes the lever to assume a position wherein the lever puts the switch in a first condition, and when the door is not closed, the cam surface causes the lever to assume a different position wherein the lever puts the switch in a second condition, and for either condition the signal means indicates accordingly.

* * * * *